United States Patent [19]

Nicoloso

[11] Patent Number: 4,612,428

[45] Date of Patent: Sep. 16, 1986

[54] COMPRESSED GAS CIRCUIT BREAKER ABLE TO BE ASSEMBLED AND DISASSEMBLED WITHOUT A SIGNIFICANT LOSS OF GAS

[75] Inventor: Dante Nicoloso, Jonage, France

[73] Assignee: Alsthom, France

[21] Appl. No.: 757,988

[22] Filed: Jul. 23, 1985

[30] Foreign Application Priority Data

Jul. 25, 1984 [FR] France ..... 84 11787

[51] Int. Cl.[4] ..... H01H 33/54

[52] U.S. Cl. ..... 200/148 R; 200/148 F; 200/148 B

[58] Field of Search ..... 200/148 R, 148 F, 148 B, 200/148 D, 148 E, 144 R

[56] References Cited

U.S. PATENT DOCUMENTS 4,386,250 5/1983 Nicoloso ..... 200/148 R

*Primary Examiner*—Robert S. Macon

*Attorney, Agent, or Firm*—Sughrue, Mion, Zinn, Macpeak, and Seas

[57] ABSTRACT

The circuit breaker comprises first (2A) and second (2B) compressed-gas-filled enclosures, said first enclosure containing fixed contacts and a moving assembly comprising contacts cooperating with said fixed contacts, which moving assembly is movable by means of a control rod (12), said second enclosure containing a connecting rod (30) articulated on a crank (40) swivelling about a shaft (41) going through the housing of the control mechanism and connected on the outside of said housing with rotational driving means, said first and second enclosures (2A, 2B) being coaxially superposed and attached together when the circuit breaker is assembled, rods (12) and (30) being fast end to end, the moving assembly then having an operating stroke going from a first position where the breaker is open to a second position where the breaker is closed. The moving assembly can be moved beyond said second, closed breaker position by an overstroke obtained by an increased rotation of said shaft (41), the latter having means for locking it in overstroke position, said first enclosure comprising a sliding, tubular air lock (50) able, when the moving assembly is in overstroke position, to assume a position sealingly closing off said first enclosure.

3 Claims, 6 Drawing Figures

COMPRESSED GAS CIRCUIT BREAKER ABLE TO BE ASSEMBLED AND DISASSEMBLED WITHOUT A SIGNIFICANT LOSS OF GAS

High-voltage circuit breakers filled with a dielectric gaseous fluid, usually sulfur hexafluoride gas ($SF_6$), are well known. Such circuit breakers are very large and, for transport purposes, generally must be built up of several elements assembled at the site of their employment. They are filled with pressurized gas at the site of manufacture. For technical reasons, these circuit breakers must be able to be dismantled in view of their transport or of the maintenance of the various elements therein without the gas contained in each element escaping.

The same no-loss requirement applies to circuit breaker reassembly operations.

$SF_6$ breakers having devices enabling their gas-tight assembly and disassembly at the factory or installation site are taught in U.S. Pat. No. 4,386,250. However, the devices are practicable only with breakers in which movement of the moving contacts is operated by a sliding rod commonly connected directly to the piston rod of a hydraulic cylinder.

When movement is transmitted to the moving contacts of the circuit breaker via a connecting rod moving at the end of a rotatively driven crank, the devices taught in the above-mentioned document are no longer applicable.

It is an object of this invention to provide a compressed gas circuit breaker being made up of a plurality of modular (being able to be assembled and disassembled) elements in which transmission of movement to the moving contacts is provided by a rod and crank system and enabling assembly and disassembly of said elements with no egress of dielectric gas and no appreciable ingress of outside air.

The invention teaches a gas circuit breaker with gas under pressure able to be assembled and disassembled without loss of gas, comprising for each pole thereof a first enclosure and a second enclosure filled with gas under pressure, said first enclosure comprising a first envelope, a base and a top and containing fixed contacts and a moving assembly comprising contacts cooperating with said fixed contacts, said moving assembly being operable to be moved by means of a control rod, said base having an axial opening for passage of said control rod, said second enclosure comprising a second envelope resting on a housing and containing a connecting rod articulated on a crank swivelling about a shaft through said housing, said shaft being connected outside the housing to rotational driving means, said second enclosure having a tubular spacer thereon, said first and second enclosures being, when the circuit breaker is assembled, coaxially superposed and fastly connected together, said connecting rod and said control rod being fast end to end, the moving assembly at this time having an operating stroke going from a first position where the breaker is open to a second position where the breaker is closed, wherein said circuit breaker the moving assembly is movable beyond said second position by an overstroke produced by an increased rotation of said shaft, said shaft comprising a means for locking it in overstroke position, said first enclosure comprising a sliding tubular air lock able, when the moving assembly is in overstroke position, to assume a position ensuring the sealed closing of said first enclosure, said air lock having an annular head in which engages a larger-diameter end piece of said control rod, said head sliding in a sealed manner in a closed cylindrical part within and coaxial to said first enclosure, the connecting rod of the second enclosure comprising a head which, when the moving assembly is in overstroke, engages in sealed manner with the spacer, said spacer having a transverse opening in line with which the ends of said control rod and connecting rod that are to be connected together meet when the bottom of the air lock comes to bear upon the spacer.

A detailed description of the invention will now be given with reference to a preferred embodiment thereof and to the appended drawings, in which.

Figure 1:
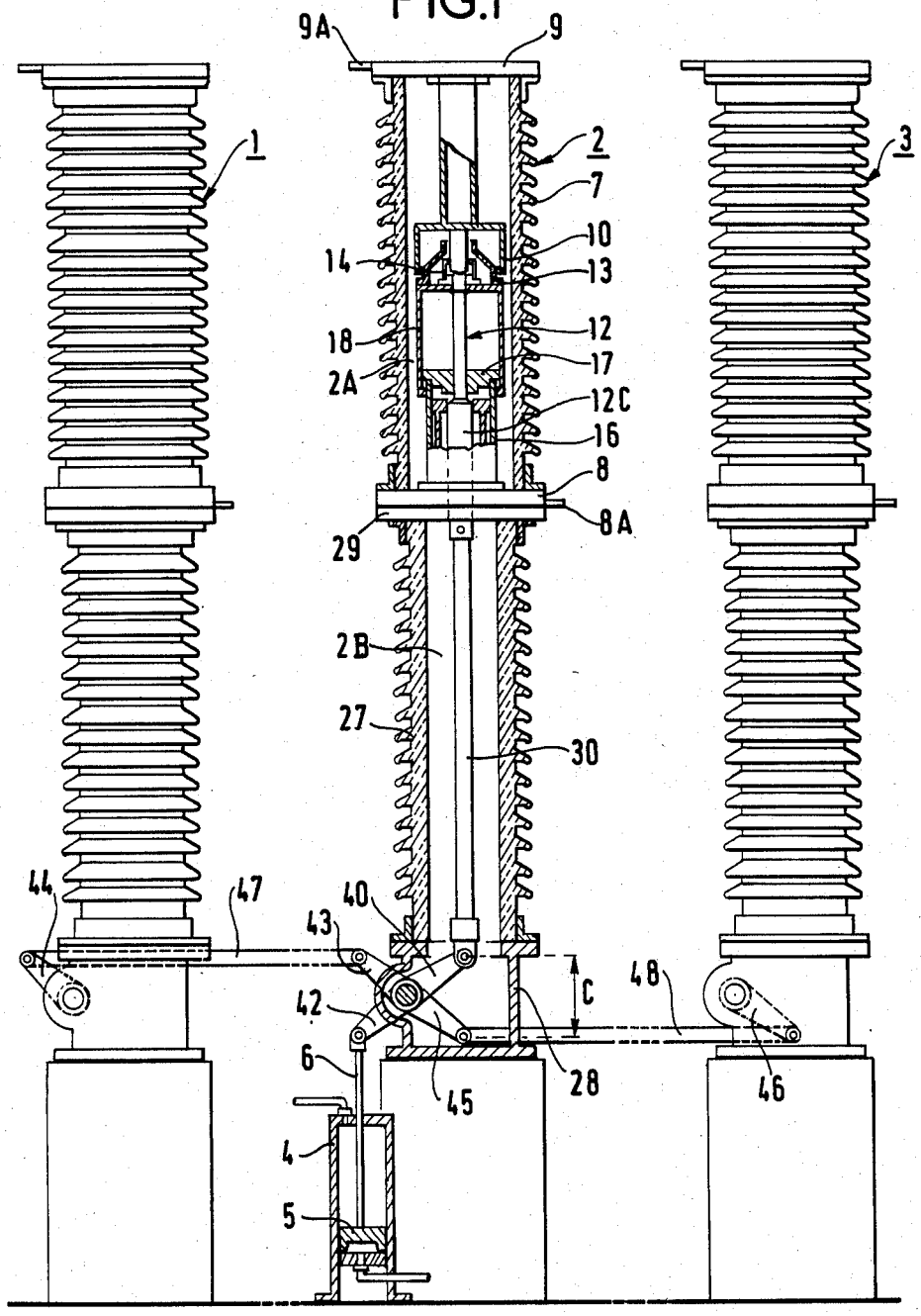
FIG. 1 is a basic elevation of a three-pole circuit breaker according to the invention, partly cut-away longitudinally.
Figure 4:
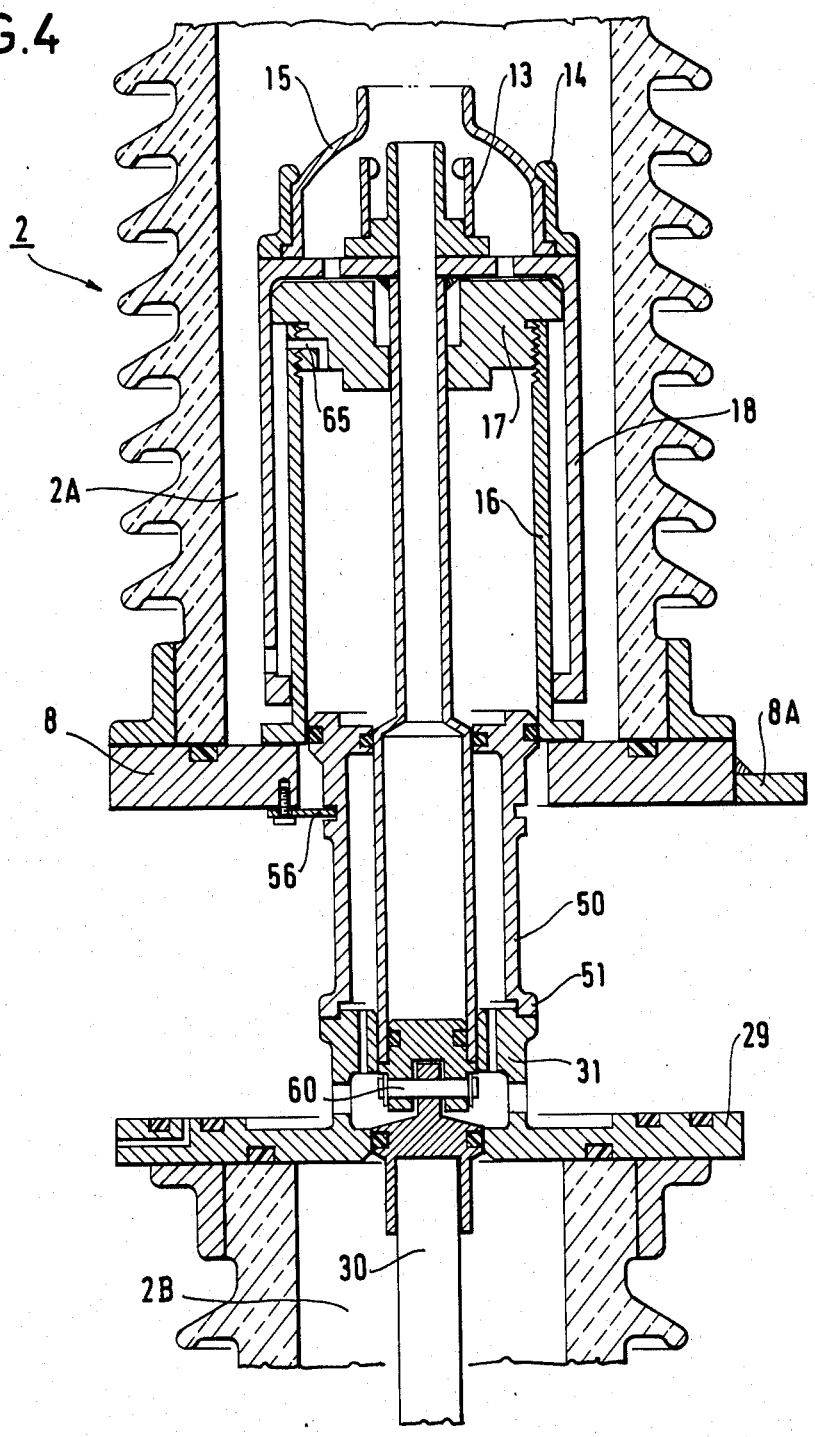
Figure 5:
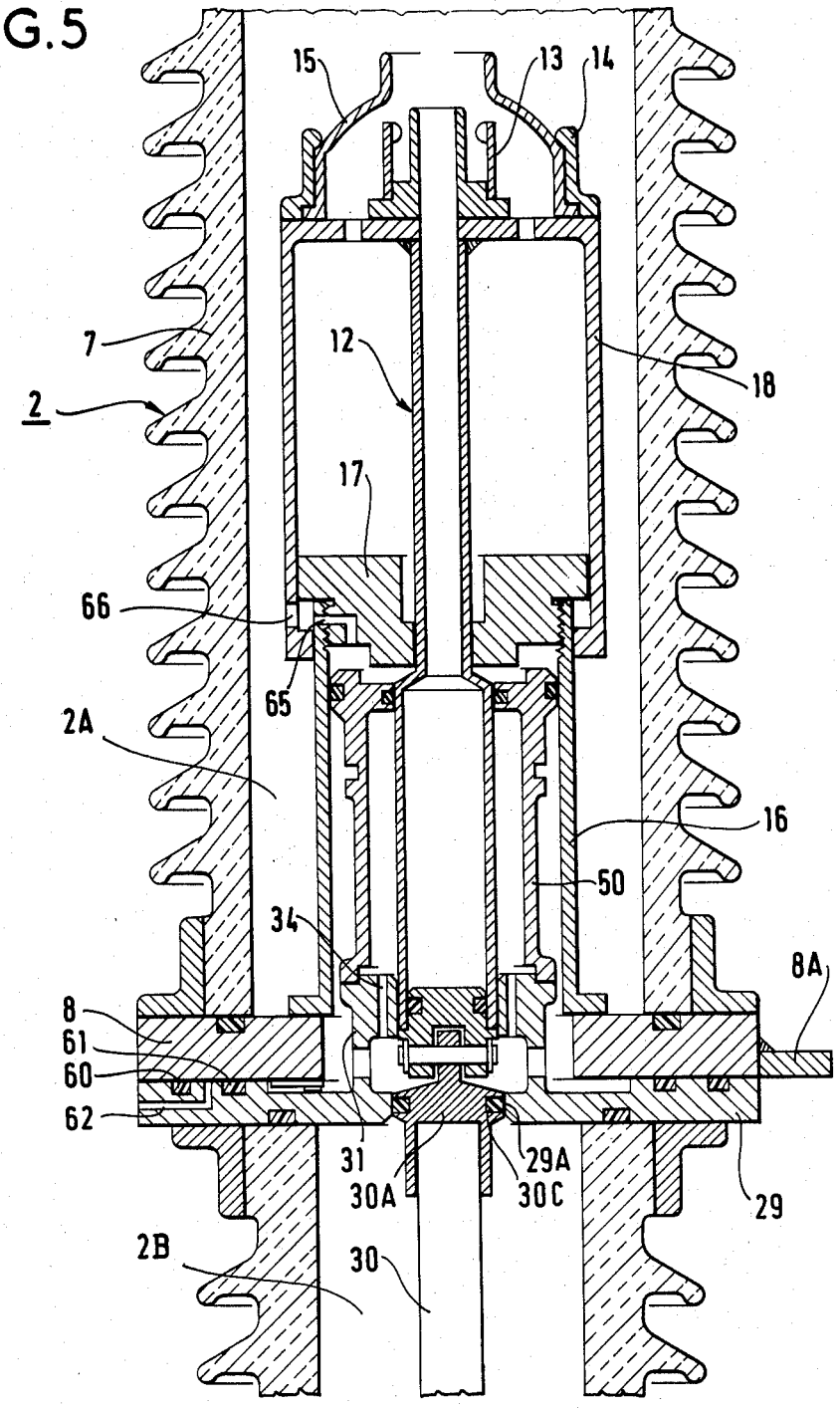
Figure 6:
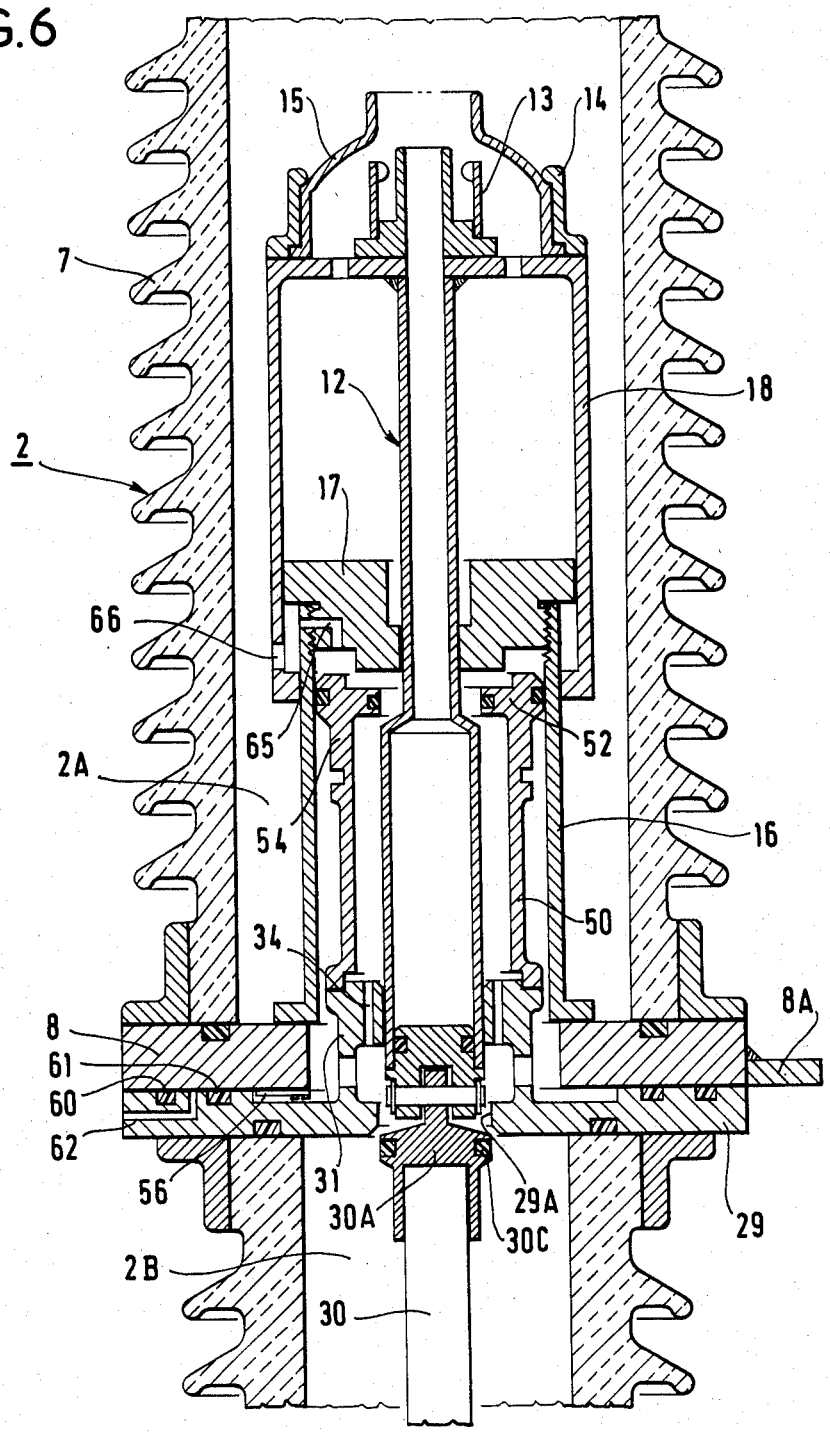

and FIGS. 4 through 6 are partial axial sectional views to a larger scale of one pole of the circuit breaker of FIG. 1 as it is configured during the subsequent assembly phases.

FIG. 1 shows a circuit breaker with three poles 1, 2 and 3 operated simultaneously by a hydraulic cylinder 4 comprising a piston 5 and piston rod 6.

The three poles are identical and pole 2, shown in axial section in FIG. 1, will now be described in detail.

Said pole 2 comprises two elements:

a first enclosure 2A, delimited by a porcelain envelope 7 having a based 8 and a top 9. The base and top carry respective external connection terminals 8A and 9A. Envelope 7 encloses a set of fixed contacts 10 and a moving assembly comprising a contact rod 12, contacts 13 and 14, a gas blast nozzle 15 and a gas blast cylinder 18. Rod 12 has a larger diameter bottom part 12C. Base 8 includes a cylindrical portion 16 comprising a gas blast piston 17 operable to slide in gas blast cylinder 18.

and a second enclosure 2B delimited by a porcelain envelope 27 the bottom part whereof rests on a housing 28 and the top whereof carries a spacer 29. Said envelope 27 contains a connecting rod 30 of insulating material articulated with a first end of an internal crank 40. The other end of said crank 40 is fixedly attached to a shaft 41 (labelled in FIG. 2) which issues outside the enclosure where a first end of an external crank 42 is attached, the other end of said crank 42 being swivelably connected to the piston rod 6 of cylinder 4.

Poles 1 and 3 are operated from shaft 41 through cranks 43, 44, 45 and 46 and connecting rods 47 and 48.

The two elements 2A and 2B are filled with compressed gas at the time of manufacture.

Alternatively, the hydraulic cylinder can be replaced by a spring control mechanism.

The invention is based upon the following observations: the normal stroke x of the circuit breaker (FIG. 2) defines a low crank position (point 0) for which the breaker is open and a high crank position (point F) for which the breaker is closed.

In accordance with the invention, a possibility is provided for the moving assembly consisting of the connecting rods, cranks and various linkages to effect an overstroke dx beyond breaker closing position. This overstroke is enabled by the relative strokes of the fixed and moving contacts of the gas blast or interrupting chamber in common types of circuit breaker. If this does not hold, the overstroke can still be obtained by lengthening the contact area between the fixed and moving contacts.

To enable application of said overstroke to the solving of the stated problem, the circuit breaker is given the following features: (a) Spacer 29 at the top of envelope 27 is given a tubular shape to establish a cylindrical passage 29A. Said spacer comprises a cylindrical stack 31 having a transverse opening 32, a top flange 33, at least one orifice 34 for passage of the gas and a zone 35 of electrical contact with rod 12.

Figure 2:
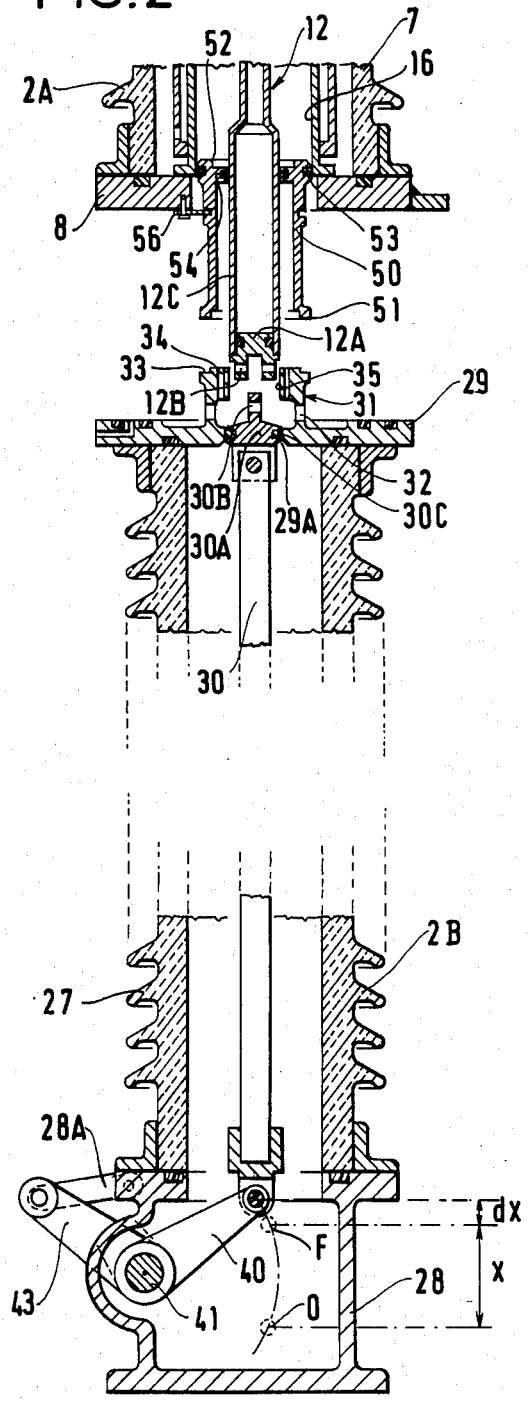
FIG. 2 is an enlarged axial sectional view of the elements forming one pole of the breaker of FIG. 1 at the beginning of the assembly operation.

(b) Rod 12 and connecting rod 30 can only be joined when both are in overstroke configuration (as rod 30 is shown to be in FIG. 2). Rods 12 and 30 are provided with end heads 12A and 30A having transverse openings 12B and 30B respectively. As will be described later herein, the two rods will be connected by inserting a fastener (pin or bolt) into opening 32.

(c) Chamber 2A includes a cylindrical air lock 50 the bottom end 51 whereof is operable to come to bear against flange 33 and the top end whereof carries a head 52 fitted with a sealing ring 53 enabling gastight sliding within cylinder 16 and a sealing ring 54 sealably pressing against the larger diameter portion 12C of rod 12.

Figure 3:
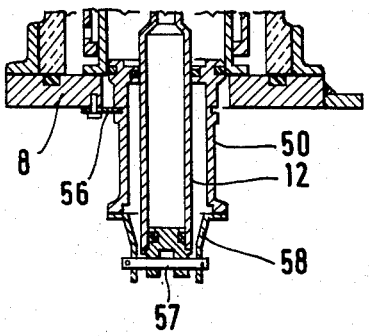
FIG. 3 is an axial sectional view of the gas blast or interrupting chamber of the circuit breaker according to FIG. 1, as it is during the transport phase prior to assembly.

In transport position, the moving elements of enclosure 2A are arranged in overstroke configuration, said air lock being immobilized with respect to base 8 by means of a dog 56 and said rod 12 being immobilized by a spindle 57 going through opening 12B and attached to the air lock by means of brackets 58 (FIG. 3).

(d) In overstroke position the head 30A of connecting rod 30 bears in a gastight manner against the wall of passage 29A through an intervening seal 30C.

This circuit breaker is assembled as per the following procedure: (1) Set the moving elements of enclosures 2A and 2B to overstroke position.

Enclosure 2A is made gastight by air lock 60 sealingly cooperating through seal 53 on cylinder 16 and seal 54 pressing against the enlarged diameter portion 12C of rod 12.

Similarly, enclosure 2B is made gastight by head 30A sealingly closing passage 29A with seal 30C.

Rod 30 is maintained in overstroke position by a lug 28A making crank 43 fast on base 28.

(2) Take spindle 57 out of enclosure 2A and set the latter on enclosure 2B (FIG. 2), so that heat 12A fits into stack 31.

(3) When the end 51 of the air lock comes into contact with flange 33, attach rod 12 and rod 30 together with a pin 60 or other suitable means.

(4) After freeing dog 56, lower envelope 7 so that air lock 50 fits into cylindrical part 16. When base 8 comes into contact with the top of spacer 29, attach base 8 and spacer 29 together with any suitable means, such means not being shown in the drawings of FIGS. 4 and 5.

Tightness is provided by O-rings 60 and 61 separated by a leakage recovery channel 62.

(5) Then release crank 43 by moving lug 28A and work the cylinder to eliminate the overstroke dx. This produces the configuration illustrated in FIG. 6.

The seal 54 of air lock 50 head 52 now surrounds a small-diameter portion of rod 12, thus ending the sealing action. Similarly, connecting rod 30 head 30A clears out of passage 29A.

Gas flow between enclosures 2A and 2B is also enabled by orifices 34 in spacer 31 and by at least one duct such as 65 provided in piston 17, said duct issuing, when the circuit breaker is in closed configuration, in front of a bore 66 in the gas blast cylinder.

The only air volume introduced into the enclosures during the assembly procedure is that contained in the combined inside volumes of the stack 31 and the air lock 50, which are very small compared with the overall volume of gas in the circuit breaker.

Dismantling of the circuit breaker is carried out by following the same steps as for assembly, in reverse. Loss of dieletric gas during disassembly is negligible.

What is claimed is:

1. A compressed gas circuit breaker able to be assembled and disassembled without significant loss of gas, comprising for each pole thereof a first enclosure and a second enclosure filled with gas under pressure, and first enclosure comprising a first envelope, a base and a top and containing fixed contacts and a moving assembly comprising contacts cooperating with said fixed contacts, said moving assembly being operable to be moved by means of a control rod, said base having an axial opening for passage of said control rod, said second enclosure comprising a second envelope resting on a housing and containing a connecting rod articulated on a crank swivelling about a shaft through said housing, said shaft being connected outside the housing to rotational driving means, said second enclosure having a tubular spacer thereon, said first and second enclosures being, when the circuit breaker is assembled, coaxially superposed and fastly connected together, said connecting rod and said control rod being connected fast end to end, said moving assembly thus having an operating stroke going from a first position where the breaker is open to a second position where the breaker is closed, wherein said circuit breaker said moving assembly is movable beyond said second position by an overstroke produced by an increased rotation of said shaft, said shaft comprising a means for locking it in overstroke positon, said first enclosure comprising a sliding tubular air lock operable, when the moving assembly is in overstroke configuration, to assume a position ensuring gastight closure of said first enclosure, said air lock having an annular head in which engages a larger-diameter end piece of said control rod, said head sliding in a sealed manner in a closed cylindrical part within and coaxial to said first enclosure, the connecting rod of the second enclosure comprising a head which, when the moving assembly is in overstroke configuration, engages in a gastight manner with the spacer, said spacer having a transverse opening in line with which the ends of said control rod and connecting rod that are to be connected together meet when the bottom of the air lock comes to bear upon the spacer.

2. Circuit breaker according to claim 1 wherein said closed cylindrical part inside said first enclosure is closed by a fixed gas blast piston around which a cylinder connected to the moving assembly is operable to slide.

3. Circuit breaker according to claims 1 and 2, wherein said air lock is fixed in position of sealing said first enclosure by a dog fastened to said base of the first enclosure.

* * * * *